US011148685B2

(12) United States Patent
Stojc et al.

(10) Patent No.: US 11,148,685 B2
(45) Date of Patent: Oct. 19, 2021

(54) PRE-BIASED DELAYED EMERGENCY RELEASE

(71) Applicant: Westinghouse Air Brake Technologies Corporation, Wilmerding, PA (US)

(72) Inventors: Andre Stojc, Ile Bizard (CA); Daniel Filion, Prevost (CA)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 807 days.

(21) Appl. No.: 15/773,312

(22) PCT Filed: Oct. 31, 2016

(86) PCT No.: PCT/US2016/059666
§ 371 (c)(1),
(2) Date: May 3, 2018

(87) PCT Pub. No.: WO2017/091323
PCT Pub. Date: Jun. 1, 2017

(65) Prior Publication Data

US 2018/0319410 A1 Nov. 8, 2018

Related U.S. Application Data

(60) Provisional application No. 62/258,673, filed on Nov. 23, 2015.

(51) Int. Cl.
*B61D 19/02* (2006.01)
*E05F 15/40* (2015.01)
(Continued)

(52) U.S. Cl.
CPC ..... *B61D 19/023* (2013.01); *B61D 19/026* (2013.01); *E05B 47/0006* (2013.01);
(Continued)

(58) Field of Classification Search
CPC ..... E05Y 2201/22; E05Y 2201/246; E05Y 2900/51; E05Y 2900/132; E05Y 2900/531; E05Y 2201/244; E05Y 2201/462; E05Y 2201/488; E05Y 2800/25; E05Y 2800/252; E05Y 2201/214; E05Y 2201/654;
(Continued)

(56) References Cited

U.S. PATENT DOCUMENTS 4,198,786 A * 4/1980 Monot ..... B61D 19/02 49/362
6,032,416 A * 3/2000 Springer ..... B60J 5/062 49/119
(Continued)

FOREIGN PATENT DOCUMENTS

EP 0736655 A1 10/1996
EP 1365095 A2 11/2003

*Primary Examiner* — Mark A Williams
(74) *Attorney, Agent, or Firm* — Christopher R. Carroll

(57) ABSTRACT

The manual release mechanism described herein enables a passenger to attempt to manually open the door but delays opening until the vehicle is no longer moving. A motion transfer device moves to an unlocking position of the door lock only when the manual release mechanism is activated to release store energy in a mechanical energy storage device and an electromechanical device is de-energized to release the motion transfer device.

10 Claims, 4 Drawing Sheets

(51) Int. Cl.
*E05B 47/00* (2006.01)
*E05B 79/20* (2014.01)
*E05B 83/36* (2014.01)

(52) U.S. Cl.
CPC ..... *E05B 79/20* (2013.01); *E05B 83/363* (2013.01); *E05F 15/40* (2015.01); *E05Y 2201/22* (2013.01); *E05Y 2201/244* (2013.01)

(58) Field of Classification Search
CPC ..... E05Y 2600/13; E05Y 2201/422; E05Y 2201/46; E05Y 2600/31; E05Y 2800/746; E05Y 2900/506; E05F 15/646; E05F 15/655; E05F 15/643; E05F 15/635; E05F 1/16; E05F 11/54; E05F 15/686; E05F 15/72; E05F 1/006; E05F 15/40; B61D 19/023; B61D 19/00; B61D 19/005; B61D 19/026; E05C 2007/007; Y10T 292/11; Y10T 292/0908; Y10T 70/5173; E05B 47/0006; E05B 79/20; E05B 83/363
See application file for complete search history.

(56) References Cited

U.S. PATENT DOCUMENTS 6,863,001 B2 * 3/2005 Inage ..... B61D 19/02 105/341
2002/0149210 A1 * 10/2002 Rizk ..... E05B 83/363 292/336.3
2005/0235866 A1 * 10/2005 Stojc ..... E05F 15/40 105/343
2010/0188177 A1 * 7/2010 Inage ..... B61D 19/02 335/205
2011/0041408 A1 * 2/2011 Lopez Saez ..... B60J 5/062 49/260
2011/0308164 A1 * 12/2011 Terasaki ..... B61D 19/026 49/360
2013/0020815 A1 * 1/2013 Smith ..... E05C 17/60 292/251.5
2014/0366449 A1 * 12/2014 Masuda ..... E05B 83/42 49/281
2018/0283057 A1 * 10/2018 Stojc ..... E05B 81/08

* cited by examiner

PRE-BIASED DELAYED EMERGENCY RELEASE

CROSS REFERENCE TO RELATED APPLICATIONS

This application claims the benefit to U.S. Provisional Application No. 62/258,673 filed Nov. 23, 2015, the disclosure of which is hereby incorporated in its entirety by reference.

BACKGROUND OF THE INVENTION

Field of the Invention

This invention relates to a manual emergency release mechanism for transit vehicle doors. It is essential that transit vehicle doors be locked during normal operation while the vehicle is moving so that a passenger leaning against or falling against the door does not push open the doors and fall out of the vehicle. However, in an emergency, there must be a provision for unlocking the door. Certain Transit Authority operational procedures require the train to have reached full stop prior to allowing the doors to be unlocked, even in an emergency situation.

In the case of emergency, a passenger actuates a release handle. The handle (rotating or linear motion) pulls on a release cable. The release cable is connected to the door lock actuator mechanism to unlock the door.

The manual release mechanism described herein enables a passenger to attempt to manually open the transit door but delays opening until the vehicle is no longer moving.

Description of Related Art

FIG. 4 illustrates one of many types of transit vehicle doors. Specifically, FIG. 4 is a plan view of a typical slide-glide door. The door panels 50 move from the closed position to an open position generally perpendicular to the closed position. The door panels 50 are hung from a track 51 that is parallel to the closed door by follower 52. The door is caused to open by rotation of door post 56 connected to the leading edge (when opening) by lever 57 extending from the door post. The door post is caused to rotate by door operator 53 via connecting rod 54 and bell crank 55.

A door lock may be associated with any number of the elements from the door operator to the door post and door panel.

Usually, a manual release cable is coupled directly to the lock actuator mechanism and the door panels become unlocked when the cable is pulled. Unfortunately, if the train is still moving, stopped between stations, or the door is on the wrong side of the vehicle while adjacent a station platform, if the door is manually unlocked, the passenger could get injured.

In the past, to prevent a passenger from leaving the car when unsafe to do so after the release handle has been actuated, the motor driving the doors was energized to attempt to keep the doors closed. However, the passenger with extra force can still force the doors open as the motors can only apply a limit amount of resistance force. Driving the doors in the closed position can cause the motors to overheat to their detriment. Also, the passenger can damage the door control mechanism when forcing the doors.

Also, in the past, a mechanism was provided to prevent the release handle from being moved so long as it is unsafe and, thus, the release cable from being pulled. However, this can frustrate the passenger and result in the handle being broken by the application of too much force. Also, when safe to do so, the passenger must again actuate the release handle. He must know when it is safe to do so.

SUMMARY OF THE INVENTION

Briefly, according to this invention, there is provided an emergency manual door lock release mechanism for releasing a door lock actuator mechanism on a transit vehicle door comprising: a motion transfer device, an electromechanical device for fixing the position of the motion transfer device when energized and releasing the motion transfer device when de-energized, a mechanical energy storage device, connections for energizing the mechanical energy storage device to bias the motion transfer device to move to an unlocking position upon closing of the transit door, a detent mechanism normally capturing the motion transfer device and releasing the motion transfer device when the detent mechanism is activated such that the door lock actuator mechanism will only be manually released when the detent mechanism is activated and the electromechanical device is de-energized to release the motion transfer device.

The motion transfer device may, for example, be a slide connected to a cable or lever connected to the door lock. The mechanical energy storage device may, for example, be a coil spring. The electromechanical device may, for example, be an electromagnet or solenoid. The manual release device may, for example, be a handle, cable, lever, or combination thereof.

Briefly, according to a specific embodiment of this invention, an emergency manual door lock release mechanism for releasing a door lock on a transit vehicle door comprises: a base plate for being secured to the transit vehicle, and a sliding plate abutting and moveable relative to the base plate. The sliding plate has at least one elongate slot. At least one pin fixed to the base plate extends into the at least one elongate slot constraining the relative movement between the base plate and sliding plate in a lateral direction.

A first end bracket is secured to the base plate at or near one lateral end of the base plate. An electromagnet is secured thereto. The first end bracket has an aperture therein for receiving a manual release Bowden cable. A second end bracket is secured to the base plate at or near the lateral end opposite from the first end bracket.

A bracket fixed to the sliding plate supports a magnetizable steel plate in a position to be captured by the electromagnet. A coil spring that stores energy upon closing of the door is biased to move the sliding plate away from the electromagnet. The coil spring is connectable to a device associated with the door for storing energy in the coil spring upon closing of the door. The coil spring is anchored directly or indirectly at one end to the second end bracket and is connected at the other end directly or indirectly to the bracket supporting the magnetizable plate. A detent mechanism fixed to the base plate normally captures the sliding plate and releases the sliding plate when the manual release cable is pulled. A motion transfer device is connected to the sliding plate such that when the sliding plate moves away from the electromagnet, the door lock will be released only when the manual release cable is pulled to release the detent mechanism and the electromagnet is de-energized to release the magnetizable steel plate.

The electromagnet electrical power is typically under the control of an ON/OFF signal issued by a combination of the train berthing system and the zero-speed system. When the train is properly berthed and at zero speed, the electromagnet is de-energized. It is energized whenever these conditions are not met.

Also, typically, there is a separate pull cable on the door lock actuating mechanism (not shown) allowing the door to be unlocked in normal service independently of the emergency release.

BRIEF DESCRIPTION OF THE DRAWINGS

Further features and other objects and advantages of the invention will become apparent from the following detailed description made with reference to the drawings.

DESCRIPTION OF THE INVENTION

Figure 1:
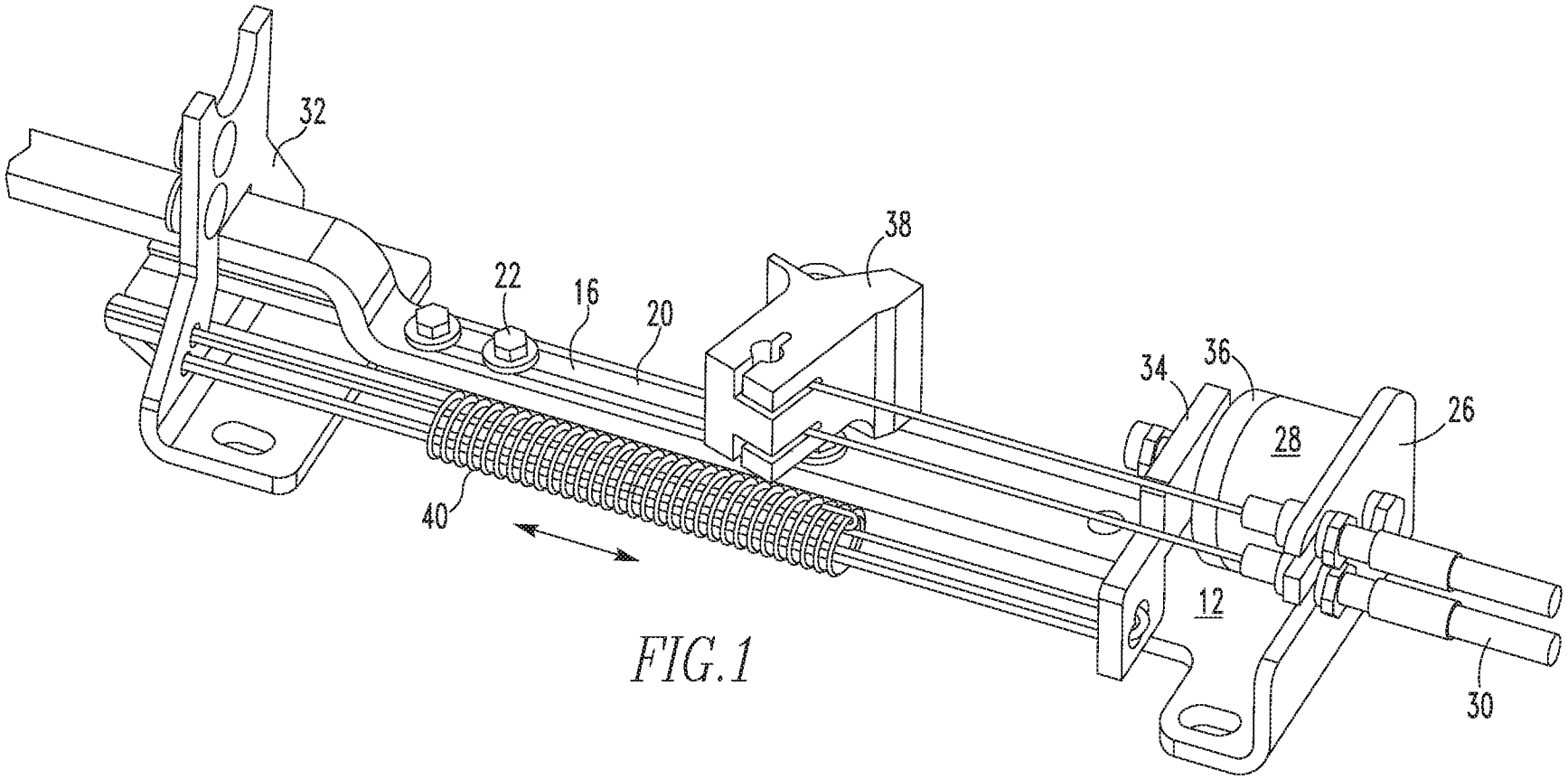
FIG. 1 is a schematic and prospective view of an emergency manual door lock release mechanism for releasing a door lock on a transit vehicle according to this invention when release is not actuated.

Referring now to the drawings, an emergency manual door lock release mechanism for releasing a door lock comprises: a base plate 12 for being secured to the transit vehicle, and a sliding plate 16 abutting and moveable relative to the base plate 12. The sliding plate 16 has at least one elongate slot 20. At least one pin 22, 24 fixed to the base plate extends into the at least one elongate slot constraining the relative movement between the base plate and sliding plate in a lateral direction indicated by the double head arrow.

A first end bracket 26 is secured to the base plate at or near one lateral end of the base plate. An electromagnet 28 is secured thereto. The first end bracket has an aperture therein for receiving a manual release Bowden cable 30. A second end bracket 32 is secured to the base plate at or near the lateral end opposite from the first end bracket 26.

A bracket 34 fixed to the sliding plate supports a magnetizable steel plate 36 in a position to be captured by the electromagnet 28. A coil spring 40 that stores energy when compressed upon closing of the door is biased to move the sliding plate 16 away from the electromagnet 28. The coil spring is anchored directly or indirectly at one end to the second end bracket 32 and is connected at the other end directly or indirectly to the magnetizable plate bracket 34.

A detent mechanism 38 fixed to the base plate 12 normally captures the sliding plate 16 and releases the sliding plate when the manual release cable 30 is pulled. The sliding plate 16 is directly or indirectly connectable to the door lock such that when the sliding plate moves away from the electromagnet 28 the door lock will be released. The door lock will only be released when the manual release cable 30 is pulled to release the detent mechanism 38 and the electromagnet 28 is de-energized to release the magnetizable steel plate 34.

Referring to FIG. 1 sliding plate 16 is retracted. The coil spring 40 is stretched to store energy to bias the sliding plate 16 away from the electromagnet 28, the electromagnet 28 is energized capturing the magnetizable steel plate 36, and the detent mechanism 38 has captured the sliding plate 16. This is the condition when the transit vehicle is moving between stations.

Figure 2:
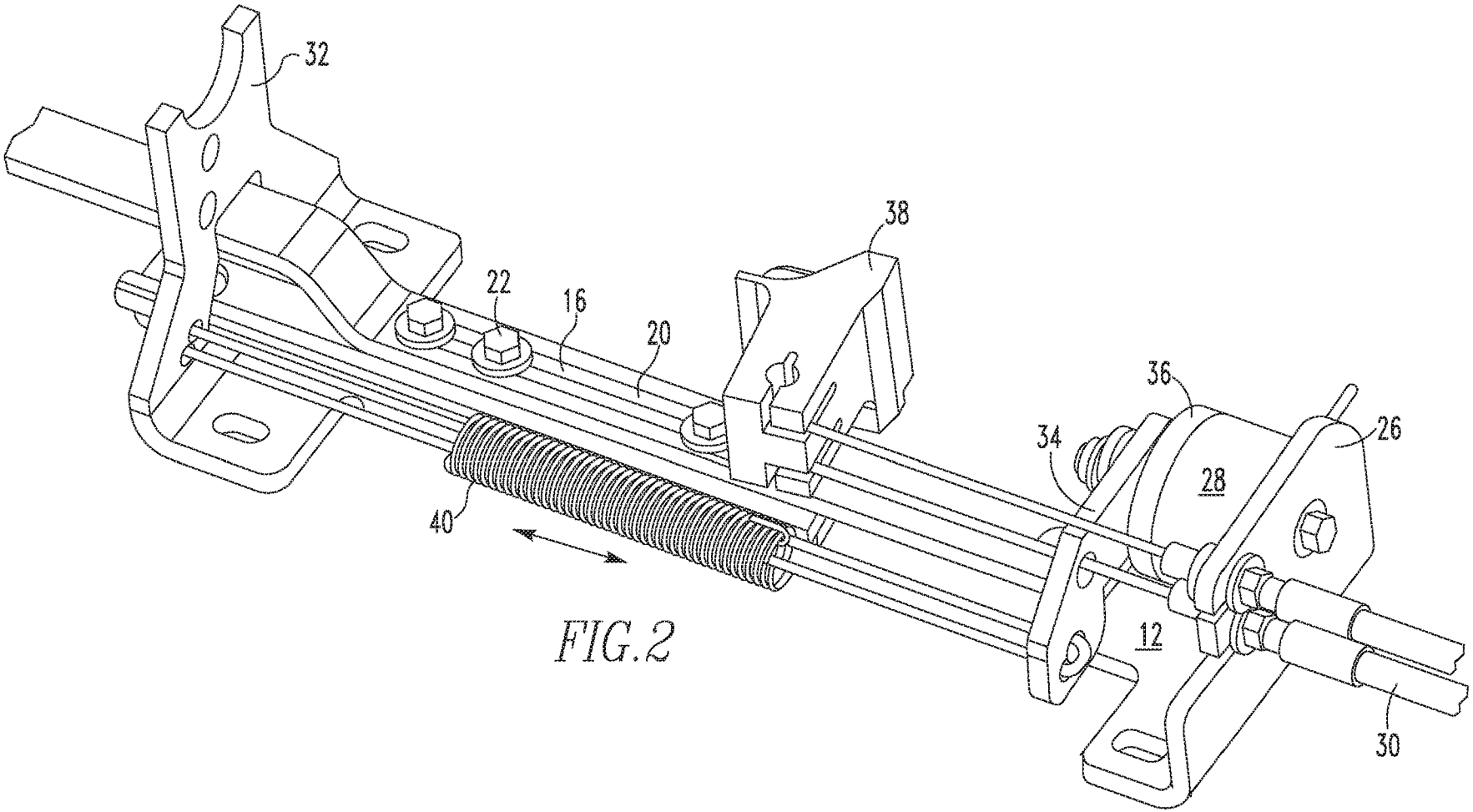
FIG. 2 is a schematic and prospective view of an emergency manual door lock release mechanism for releasing a door lock on a transit vehicle according to this invention when manual release has been attempted but the door lock is not released.

Referring to FIG. 2, the emergency manual door lock release mechanism is shown when manual release has been attempted but the door lock is not released. The manual release cable 30 has been pulled and the detent mechanism 38 has been disengaged from the sliding plate 16. The coil spring 40 remains energized and the electromagnet 28 remains energized to hold the magnetizable steel plate 36 and, therefore, the sliding plate 16 in the retracted position. This is the condition when a passenger has attempted manual release and, for example, the transit vehicle is still moving.

Figure 3:
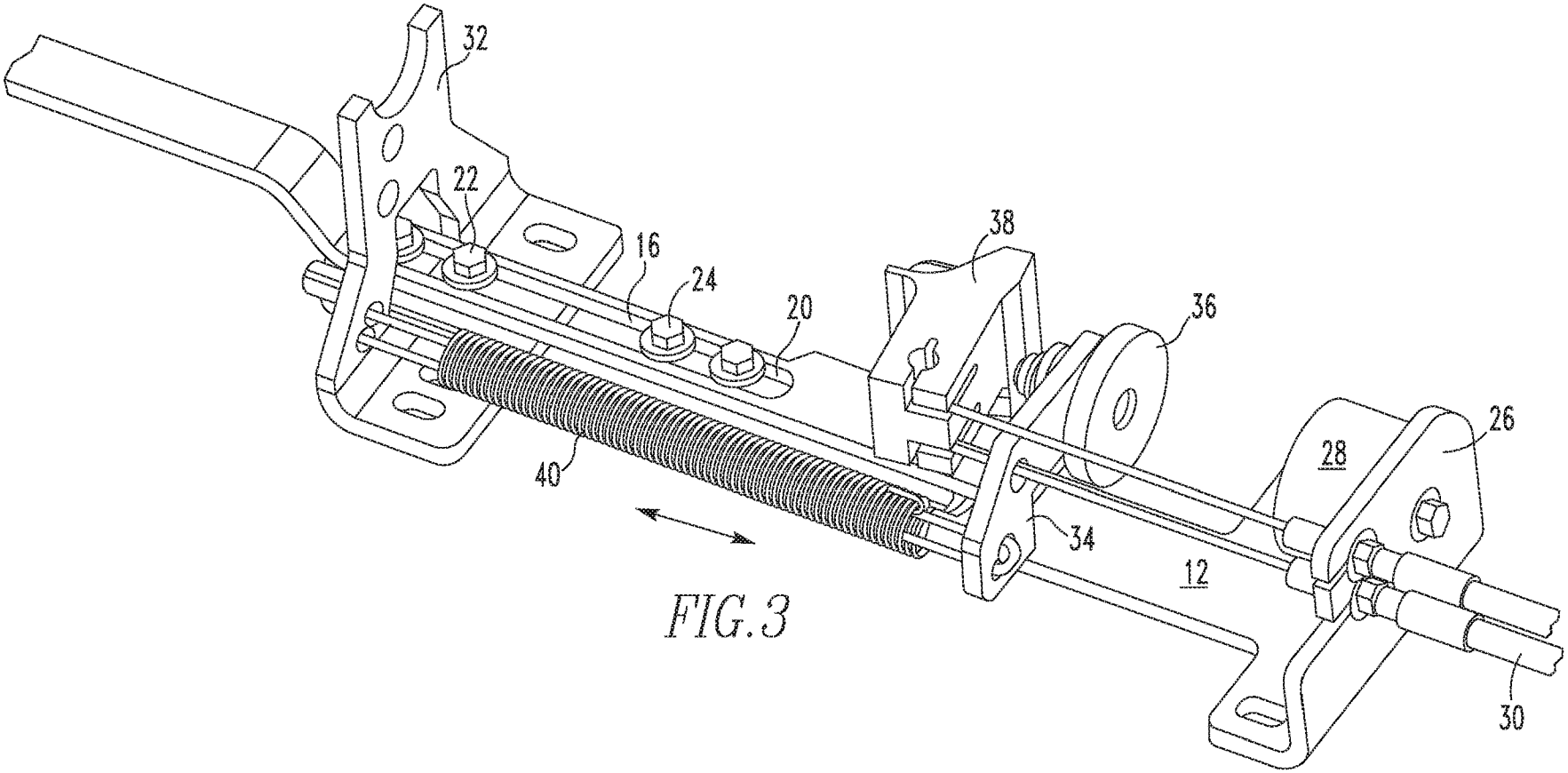
FIG. 3 is a schematic and prospective view of an emergency manual door lock release mechanism for releasing a door lock on a transit vehicle according to this invention when manual release has been attempted and the door lock has been released.
Figure 4:
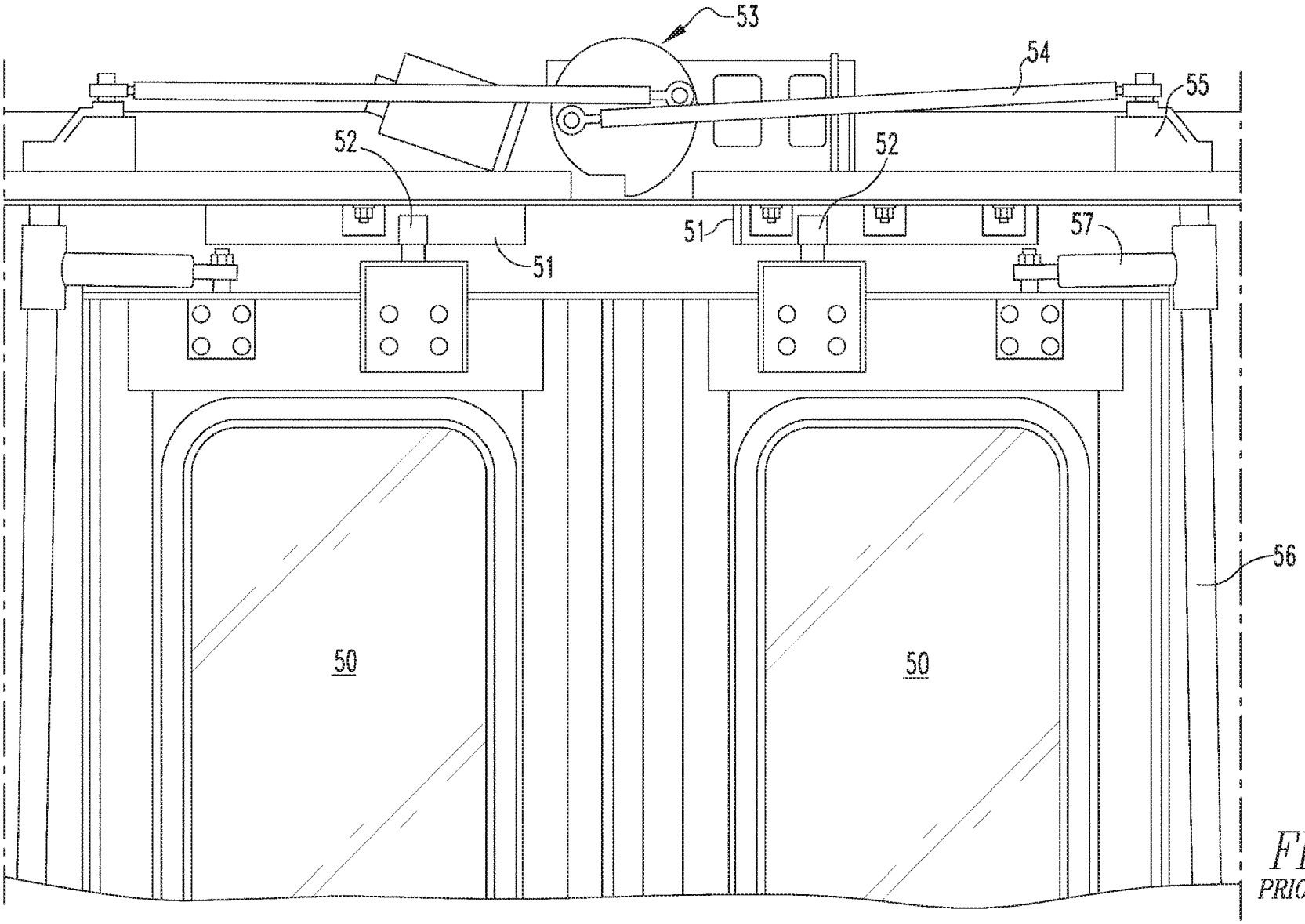
FIG. 4 PRIOR ART
FIG. 4 is a plan view of a typical slide-guide door on a transit vehicle.

Referring to FIG. 3, manual release has been attempted and the door lock has been released. The electromagnet 28 is no longer energized and the magnetizable steel plate 36 has been freed. The coil spring 40 has use stored energy to move the sliding plate 16 to its fully extended position such that the door release mechanism has unlocked the door lock so that passengers can escape the transit vehicle.

Having thus defined our invention with the detail and particularity required by the Patent Laws, what is desired protected by Letters Patent is set forth in the following claims.

The invention claimed is:

1. A door lock release mechanism comprising:

a base plate configured to be coupled with a vehicle;

a sliding plate coupled with a door lock of the vehicle, the sliding plate configured to move relative to the base plate between an extended position and a retracted position;

a magnetizable plate coupled with the sliding plate;

an electromagnet configured to fix the sliding plate in the retracted position relative to the base plate while the electromagnet is energized, the electromagnet configured to release and allow movement of the sliding plate to the extended position relative to the base plate while the electromagnet is de-energized;

a spring coupled with the base plate and coupled with the sliding plate, the spring biased to move the sliding magnetizable plate away from the electromagnet;

a detent mechanism configured to engage the sliding plate while the detent mechanism is in a first position and to disengage from the sliding plate while the detent mechanism is in a second position, the detent mechanism configured to prevent movement of the sliding plate relative to the base plate to the extended position while the detent mechanism is in the first position, the detent mechanism configured to allow movement of the sliding plate relative to the base plate to the extended position while the detent mechanism is in the second position, wherein the sliding plate is configured to move away from the electromagnet to the extended position and release the door lock while (a) the detent mechanism is in the second position and (b) the electromagnet is de-energized, and wherein the sliding plate is configured to remain in the retracted position by one or both of the detent mechanism or the electromagnet and maintain the door lock in a locked state while one or both of (c) the detent mechanism is in the second position or (d) the electromagnet is energized.

2. The door lock release mechanism of claim 1, further comprising:

a cable coupled with the detent mechanism and configured to move the detent mechanism between the first position and the second position.

3. The door lock release mechanism of claim 1, wherein the sliding plate includes a slot, and the base plate includes a pin extending through the slot in the sliding plate.

4. The door lock release mechanism of claim 1, wherein the electromagnet is coupled with the base plate.

5. The door lock release mechanism of claim 1, wherein the sliding plate remains coupled with the electromagnet in the retracted position and maintain the door lock in the locked state while the electromagnet is energized.

6. The door lock release mechanism of claim 1, wherein the electromagnet is configured to be energized by a train berthing system and a zero-speed system of the vehicle, the electromagnet de-energized by the train berthing system and the zero-speed system while the vehicle is berthed and stationary.

7. A door lock release mechanism comprising:

a base plate for being secured to a vehicle;

a sliding plate abutting and movable relative to the base plate, the sliding plate having at least one elongate slot, at least one pin fixed to the base plate extending into the at least one elongate slot constraining the relative movement between the base plate and sliding plate in a lateral direction;

a first end bracket secured to the base plate at or near a first lateral end of the base plate and having an electromagnet secured thereto, the first end bracket having an aperture therein for receiving a manual release cable;

a second end bracket secured to the base plate at or near a second lateral end that is opposite the first end bracket;

a bracket fixed to the sliding plate and supporting a magnetizable plate in a position to be captured by the electromagnet;

a coil spring that stores energy upon closing of a door to bias the spring to move the sliding plate away from the electromagnet, the coil spring anchored at a first end to the second end bracket and connected at a second end to the bracket supporting the magnetizable plate; and a detent mechanism fixed to the base plate that captures the sliding plate and releases the sliding plate, the sliding plate connected to a door lock such that when the manual release cable is pulled, the sliding plate moves away from the electromagnet, the door lock manually released only when the manual release cable is pulled to release the detent mechanism and the electromagnet is de-energized to release the magnetizable plate.

8. The door lock release mechanism of claim 7, further comprising:

the manual release cable coupled with the detent mechanism and configured to move the detent mechanism.

9. The door lock release mechanism of claim 7, wherein the sliding plate remains coupled with the electromagnet and maintains the door lock in a locked state while the electromagnet is energized.

10. The door lock release mechanism of claim 7, wherein the electromagnet is configured to be energized by a train berthing system and a zero-speed system of the vehicle, the electromagnet de-energized by the train berthing system and the zero-speed system while the vehicle is berthed and stationary.

* * * * *